US008425958B2

(12) United States Patent
Bontemps et al.

(10) Patent No.: US 8,425,958 B2
(45) Date of Patent: Apr. 23, 2013

(54) PACKAGING COMPRISING A HEAT SHRINKING FILM

(75) Inventors: Antoine Bontemps, Thayngen (CH); Loic Faulon, Singen-Beuren (DE)

(73) Assignee: Nestec S.A., Vevey (CH)

( * ) Notice: Subject to any disclaimer, the term of this patent is extended or adjusted under 35 U.S.C. 154(b) by 194 days.

(21) Appl. No.: 12/864,175

(22) PCT Filed: Jan. 6, 2009 (Under 37 CFR 1.47)

(86) PCT No.: PCT/EP2009/050070

§ 371 (c)(1), (2), (4) Date: Jul. 22, 2010

(87) PCT Pub. No.: WO2009/092622

PCT Pub. Date: Jul. 30, 2009

(65) Prior Publication Data

US 2010/0297308 A1 Nov. 25, 2010

(30) Foreign Application Priority Data

Jan. 23, 2008 (EP) ..... 08100797

(51) Int. Cl.
*A21D 10/02* (2006.01)

(52) U.S. Cl.
USPC ..... 426/107; 426/113; 219/730; 99/352

(58) Field of Classification Search ..... 426/107, 426/113; 219/730; 99/352
See application file for complete search history.

(56) References Cited

U.S. PATENT DOCUMENTS

| | | | | |
|---|---|---|---|---|
| 4,268,738 | A * | 5/1981 | Flautt et al. | 219/759 |
| 4,775,771 | A * | 10/1988 | Pawlowski et al. | 219/730 |
| 4,985,300 | A | 1/1991 | Huang | |
| 6,168,812 | B1 * | 1/2001 | Paulucci | 426/107 |
| 2003/0206997 | A1 * | 11/2003 | Winkelman et al. | 426/107 |
| 2008/0087664 | A1 * | 4/2008 | Robison et al. | 219/727 |

FOREIGN PATENT DOCUMENTS

| | | |
|---|---|---|
| EP | 0000797 | 2/1979 |
| GB | 2369341 | 5/2002 |
| GB | 2300791 | 10/2010 |
| JP | 61208444 | 9/1986 |
| JP | 2000007046 | 1/2000 |
| JP | 2006321533 | 11/2006 |
| WO | WO03066435 | 8/2003 |

OTHER PUBLICATIONS

International Search Report for International Application No. PCT/EP2009/050070 mailed on Apr. 15, 2009.
Written Opinion for International Application No. PCT/EP2009/050070 mailed on Apr. 15, 2009.

* cited by examiner

*Primary Examiner* — Rena Dye
*Assistant Examiner* — Chaim Smith
(74) *Attorney, Agent, or Firm* — K&L Gates LLP

(57) ABSTRACT

The present invention concerns an assembly comprising a food product (15) to be heated or cooked in a microwave device, a packaging (13) surrounding said food product, wherein said packaging has at least one surface to come into contact with said food product and is made at least partly of a susceptor, and a heat shrinking film (16).

14 Claims, 3 Drawing Sheets

PACKAGING COMPRISING A HEAT SHRINKING FILM

CROSS-REFERENCE TO RELATED APPLICATIONS

The present application is a National Stage of International Application No. PCT/EP09/50070, filed on Jan. 6, 2009, which claims priority to European Patent Application No. 08100797.3, filed on Jan. 23, 2008, the entire contents of which are being incorporated herein by reference.

FIELD OF THE INVENTION

The present invention concerns an assembly comprising a heat shrinking film for a microwave heating or cooking of a food product.

BACKGROUND

The WO patent 03/066435 concerns a method for enhancing the cooking performance of microwave interactive packaging material comprising closed cells. Under the influence of the microwave field, these closed cells inflate and therefore bring the susceptor layer in closer contact to the food product. The problem with such a solution is that it is not possible to guarantee a continuous contact with the food product, because of the non flat surface of the inflated cells; the susceptor is therefore not fully in contact with the food product. Furthermore, the composition of the overall packaging material of this patent is complex and is composed of several layers, which finally leads to an expensive solution. The U.S. Pat. No. 4,985,300 concerns a heat shrinkable film useful for packaging for cooking a food product in a microwave oven. The film according to this invention is multi-layers and besides the shrink base film comprises also a microwave susceptor layer, an adhesive layer for holding the surrounding layers together, and eventually a protective layer as well as a heat sealable layer.

The objective of the present invention is to find a solution for microwaveable products, wherein the distance and/or degree of and/or intensity of contact between the susceptor and the food product during microwaving is increased to obtain a better texture and other sensory attributes of the food product, with an efficient and cheaper solution than in the prior art.

SUMMARY

The present invention concerns an assembly comprising: a food product to be heated or cooked in a microwave device, a packaging surrounding said food product, wherein said packaging has at least one surface to come into contact with said food product and is made at least partly of a susceptor, and a heat shrinking film.

Under better texture, we understand herewith a controlled softness, a better crispiness and controlled hardness. Under other sensory attributes, we understand an improved appearance, like browning.

According to the invention, there are at least 3 different embodiments. In a first embodiment, a surface is bound with an opposite surface using a heat shrinking film. In a second embodiment, any kind of packaging is wrapped with a heat shrinking film. In a third embodiment, a heat shrinking film is fixed on 2 sides of a flexible packaging surrounding a food product.

For the first embodiment, several solutions can be considered. According to a first solution, the heat shrinking film is fixed on at least one of the surface of the packaging or the outside of said packaging. If the heat shrinking film is only on one surface, the other surface has a standard packaging material. According to a second solution, the heat shrinking film is fixed on 2 opposite surfaces of the packaging. For both solutions, it is preferred that the packaging surface is foldable.

According to the invention, it is important that the food product is introduced into the packaging in a very easy manner by the consumer, before microwaving. And then during microwaving, the packaging, due to the presence of the heat shrinking film, reduces in size in order to bring the susceptor closer to the food product.

According to a third solution, the heat shrinking film is fixed on one surface of the packaging and can be unfolded to be stuck on the other surface of the packaging, on the outside of said packaging. In this case, it is also preferred to have foldable sides of the packaging, so that during microwaving, the heat shrinking film forces these sides to be folded and bring the other surfaces with susceptor in closer contact with the food product.

According to a fourth solution of the first embodiment, the heat shrinking film is fixed on the opposite surfaces of the packaging forming the upper and lower parts of said packaging. In this case, it means that two heat shrinking films are fixed on the opposite sides of the packaging.

According to a fifth solution, the heat shrinking film is fixed on several corners of said packaging. Preferably, in the case of a square or rectangular packaging, the heat shrinking film is fixed on the four corners of the packaging.

According to a sixth solution, the packaging comprises a lid with a susceptor, said lid being maintained on the remainder of the packaging with a shrinking film on the whole periphery of said packaging. This is preferably a packaging in the form of a cup, made in a standard material. During the microwave heating the heat shrinking film operates to bring the lid closer to the top surface of the food product.

According to a seventh solution, the packaging comprises a lid with a susceptor, said lid being maintained on the remainder of the packaging with a stripe of heat shrinking film. In this case, the form of the packaging is square or rectangular. The objective here also, is to bring the lid closed to the top surface of the food product.

According to the second embodiment of the invention, the food product is fully surrounded with the shrinking film. In this case, the packaging is disposed between the food product and the heat shrinking film. The objective is the same as before, that means, during microwaving, the shrinking of the film brings the packaging with susceptor in closer contact with the food product. The food product and therefore the packaging can be in square, rectangular or cylindrical shape.

For this embodiment, it is possible to have one single piece of shrinking film or several bands of shrinking film.

According to a third embodiment of the invention, the food product in cylindrical shape comprises a flexible packaging closed with at least one band of heat shrinking film. In this case, the band of shrinking film is only fixed on one part of the periphery. The shrinking film does not surround totally the packaging.

Depending on the different embodiments taken into consideration, the food product is selected from the group consisting of dough based products; fried products, like nuggets and French fries; and grilled-like products, like meat steak and gratinated products. For example, concerning the first embodiment, it will be more for products like croque monsieur. Concerning the first embodiment, sixth solution, it will be for a mini-cup, for example for a mini gratin. Concerning the second embodiment, it will be also for croque monsieur or a mini-pizza or a mini quiche. Concerning the third embodiment, it will be for a rolled product, like rolled dough.

The shrinking material is selected from the group consisting of polyester, polyolefin, polyethylene terephthalate, polypropylene, polyvinyl chloride alone or in combination or any other kind of plastic material.

Most products lose size during microwaving, like croque monsieur, thus the susceptor may loose its contact with the food product. With the assembly of the invention, it is possible to solve this problem. The purpose of the invention is to keep the susceptor in stronger contact with the food product, while bringing closer the different parts of the susceptor to the food product, like a dough. With the invention, because of the better heat transfer, we can also obtain a quicker heating step and/or better heat distribution. The microwaved product has also a controlled humidity and controlled softness, as well as controlled hardness and increased crispiness, and increased heating.

Additional features and advantages are described herein, and will be apparent from the following Detailed Description and the figures.

DETAILED DESCRIPTION

Figure 1:
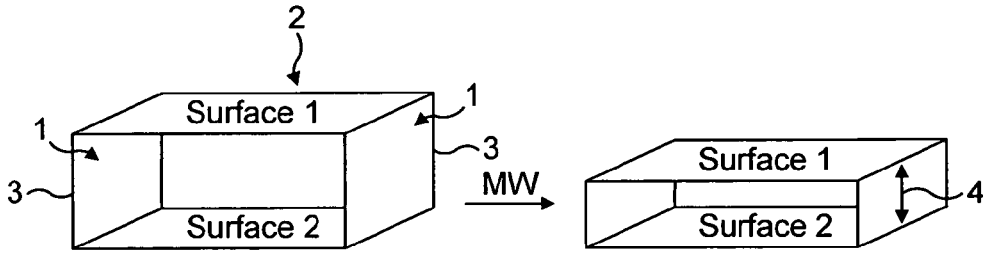
FIG. 1 is a schematic view of a first embodiment of the present invention.

In the first embodiment, described and depicted in FIG. 1, the packaging (2) includes a food product (not shown). The 2 opposite surfaces (1) of said packaging comprise each a heat shrinking film (3). When the consumer introduces the packaging in the microwave oven (MW), both films shrink according to arrow (4), so that the surfaces 1 and 2 come closer to each other. The result is that a susceptor forming surface 1 and 2 come closer to the food product, leading to a browning and crispiness of the surface of the food product.

Figure 2:
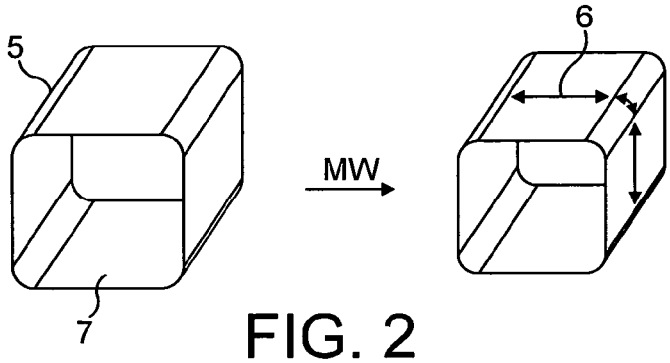
FIG. 2 is a schematic view of a second embodiment of the present invention.

FIG. 2 shows the second embodiment of the invention. The concept is the same as for FIG. 1, but in this case the shrinking film (5) surrounds totally the packaging (7). When the consumer introduces the packaging in the microwave oven (MW), the film (5) shrinks according to the arrows (6). The susceptor of the packaging comes closer to the food product leading to a browning and crispiness of the food.

Figure 3:
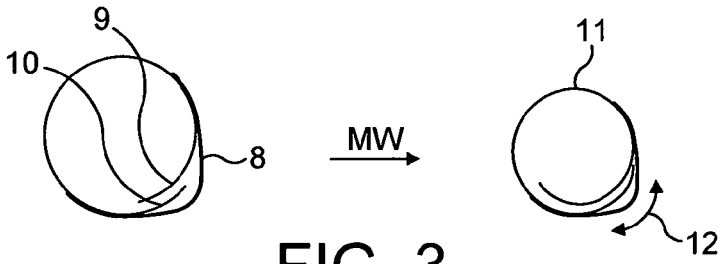
FIG. 3 is a schematic view of a third embodiment of the present invention.

The third embodiment is depicted in FIG. 3. The heat shrinking film (8) is sealed on the 2 sides (9) and (10) of a flexible packaging (11). During the passage in the microwave oven (MW), the film shrinks according to arrow (12), which leads to a deformation of the flexible packaging allowing the food product to become closer to the susceptor of the packaging.

Figure 4:
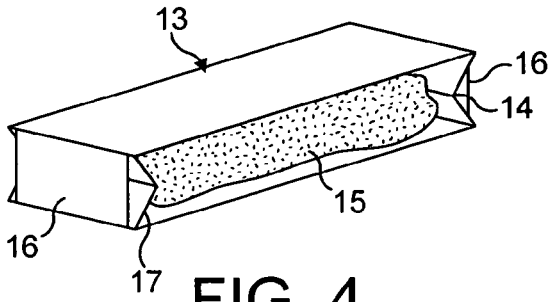
FIG. 4 is a schematic view of a second solution of the first embodiment.

Concerning now FIG. 4, the food product (15) is enclosed in the packaging (13) comprising surfaces coated with susceptor. A heat shrinkable film (16) is fixed on both opposite sides (17) of the packaging. In the microwave, the film (16) will shrink, so that the sides (17) will fold along the folding line (14).

Figure 5:
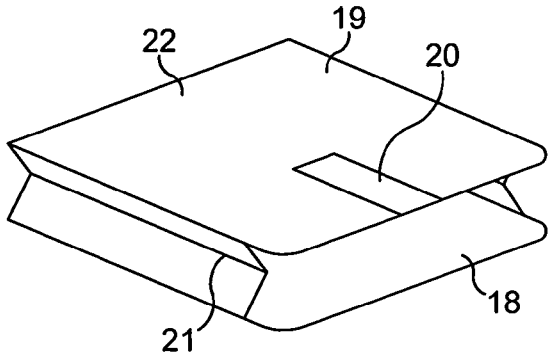
FIG. 5 is a schematic view of a third solution of the first embodiment.

Another solution is shown in FIG. 5. The food product is introduced in the aperture (18) of the packaging (19). The surfaces (22) of the packaging are coated with a susceptor. A shrinking film (20) is placed on one surface of the packaging. When the consumer wants to use it, he introduces the food product through the aperture (18) and takes the shrinking film (20) to close said aperture (18). He can then introduce the whole assembly in the microwave oven. By heating or cooking, the shrinking film (20) allows the packaging to compress the food product along the line (21).

Figure 6:
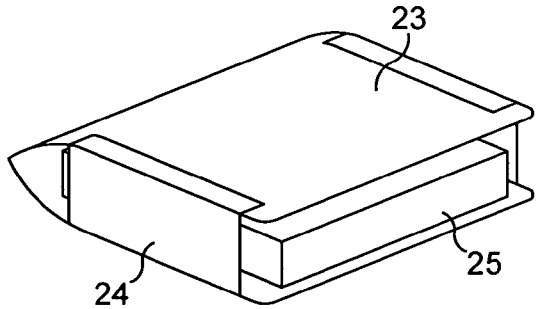
FIG. 6 is a schematic view of a fourth solution of the first embodiment.

Another solution is shown in FIG. 6. The food product (25) is disposed in the packaging (23) comprising surfaces coated with susceptor. The heat shrinking film (24) is fixed at opposite sides of the packaging on both surfaces coated with susceptor.

Figure 7:
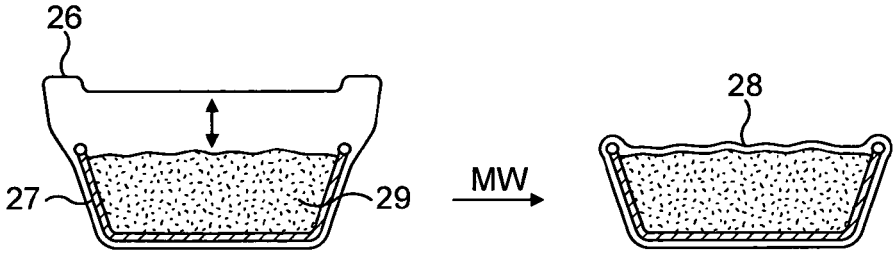
FIG. 7 is a schematic view of a sixth solution of the first embodiment.

FIG. 7 shows a mini-cup (27) containing a mini-gratin (29). A heat shrinking film (26) maintains on the whole periphery of said cup a susceptor lid (28). By putting the whole packaging in the microwave oven, the presence of the heat shrinking allows the lid to come closer to the top of the food product, creating therefore a browning and gratination of said food product.

Figure 8:
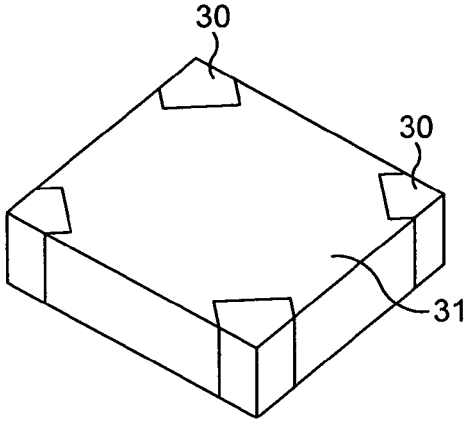
FIG. 8 is a schematic view of a fifth solution of the first embodiment.

FIG. 8 shows another solution. The packaging (31) with surfaces coated with susceptor has its 4 corners binded with heat shrinking film (30). The consumer can introduce the food product in the packaging, which is then placed in the microwave oven. The shrinking of the film on the 4 corners allows the susceptor to come closer to the food product, producing a corresponding browning and crispiness.

Figure 9:
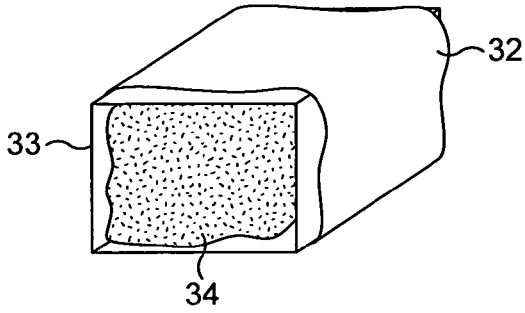
FIG. 9 is a schematic view of the second embodiment of the invention.

FIG. 9 shows the second embodiment of the invention. The food product (34) is enclosed in the packaging (33) comprising surfaces coated with susceptor. A heat shrinking film (32) surrounds totally the whole packaging. By putting the packaging in the microwave oven, the heat shrinking film brings the susceptor in closer contact with the food product, creating therefore a browning and a crispiness of said food product.

Figure 10:
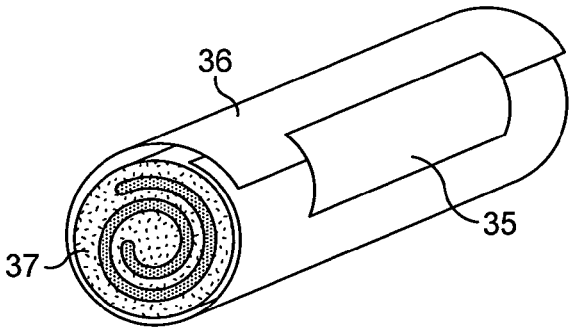
FIG. 10 is a schematic view of the third embodiment of the invention.

A third embodiment is shown in FIG. 10. The food product (37) is rolled in a flexible packaging (36) coated with a susceptor. A heat shrinking (35) closes the packaging. When the consumer introduces the packaging in the microwave oven, there is a compression of the flexible packaging allowing the susceptor to come in close contact with the food product.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An assembly comprising:

a food product that can be heated in a microwave device;

a packaging having at least two opposite surfaces into which said food product is inserted to surround the food product, said packaging having at least one surface that contacts the contained food product and is made at least partially of a susceptor; and a heat shrinking film attached to an outside surface of said packaging and binding the at least two opposite surfaces, of said packaging, such that during microwave heating the heat shrinking film reduces the packaging in size to bring the at least two surfaces and the susceptor closer to the food product.

2. The assembly of claim 1, wherein the heat shrinking film is fixed on one surface of the at least two opposite surfaces of the packaging and can be unfolded and stuck on an opposite outside surface of the packaging, the food product being located between the one surface and the opposite surface.

3. The assembly of claim 1, wherein the heat shrinking film is fixed to the outside of the packaging, said packaging surface being foldable.

4. The assembly of claim 1, wherein the heat shrinking film is fixed on more than one corner of the packaging.

5. The assembly of claim 1, wherein the packaging comprises a lid with a susceptor, the lid being maintained on a remaining portion of the packaging with a shrinking film located on a whole periphery of the packaging such that during microwave heating the shrinking film brings the lid closer to the top surface of the food product.

6. The assembly of claim 1, wherein the packaging comprises a lid with a susceptor, the lid being maintained on a remaining portion of the packaging with a stripe of heat shrinking film such that during microwave heating the stripe of heat shrinking film brings the lid closer to the top surface of the food product.

7. The assembly of claim 1, wherein the food product is fully surrounded by the shrinking film.

8. The assembly of claim 7, wherein the food product is in a shape selected from the group consisting of square, rectangular and cylindrical.

9. The assembly of claim 7, wherein the food product is surrounded by one piece of shrinking film.

10. The assembly of claim 7, wherein the food product is surrounded by several bands of shrinking film.

11. The assembly of claim 1, wherein the food product has a cylindrical shape and the packaging is a flexible cylindrical packaging closed with at least one band of heat shrinking film such that during microwave heating the heat shrinking film reduces the diameter of the flexible cylindrical packaging.

12. The assembly of claim 1, wherein the food product is selected from the group consisting of dough based products, fried products, grilled-like products, and gratinated products.

13. The assembly of claim 1, wherein the shrinking material is selected from the group consisting of polyester, polyolefin, polyethylene terephthalate, polypropylene, polyvinyl chloride alone or in combination.

14. The assembly of claim 11, wherein the flexible cylindrical packaging has a first end which overlaps a second end opposite to the first end, and the at least one band of heat shrinking film is connected to the first end and the second end and positioned over the overlap.

* * * * *